US007044313B2

(12) United States Patent
Haliburda, III

(10) Patent No.: US 7,044,313 B2
(45) Date of Patent: May 16, 2006

(54) PORTABLE HOIST

(76) Inventor: Thomas Haliburda, III, 179 Gilbert Ave., Fairborn, OH (US) 45324

( * ) Notice: Subject to any disclaimer, the term of this patent is extended or adjusted under 35 U.S.C. 154(b) by 0 days.

(21) Appl. No.: 10/654,722

(22) Filed: Sep. 4, 2003

(65) Prior Publication Data

US 2005/0051507 A1 Mar. 10, 2005

(51) Int. Cl.
*B66C 23/20* (2006.01)

(52) U.S. Cl. ..... 212/179; 182/60

(58) Field of Classification Search ..... 212/179; 182/60

See application file for complete search history.

(56) References Cited

U.S. PATENT DOCUMENTS 1,247,706 A * 11/1917 Moran ..... 212/179
2,696,917 A * 12/1954 Kershaw ..... 212/179
3,390,657 A * 7/1968 Schneider ..... 114/268
4,560,074 A * 12/1985 Manning ..... 212/179
5,341,898 A * 8/1994 Baziuk ..... 182/142
5,617,963 A * 4/1997 Baziuk et al. ..... 212/179
5,622,237 A * 4/1997 Moldow ..... 182/37
5,706,960 A * 1/1998 Pitman et al. ..... 212/304
6,039,194 A * 3/2000 Beeche et al. ..... 212/301
6,135,300 A * 10/2000 Fox ..... 212/179

FOREIGN PATENT DOCUMENTS

CH 339357 * 8/1959
FR 2679892 * 2/1993
GB 779531 * 7/1957
SU 8400006 * 6/1981

* cited by examiner

*Primary Examiner*—Thomas J. Brahan
(74) *Attorney, Agent, or Firm*—Brinks Hofer Gilson & Lione

(57) ABSTRACT

A portable hoist for preferably lifting and moving a trowel machine is disclosed. The portable hoist is comprised of a base and a plurality of legs coupled with the base. A foot is rotatably attached to one end of each of the legs. The rotatable attachment allows the foot to move about the end of the leg that the foot is attached to. The legs and the feet are used to secure the hoist, typically to a foundation wall. Also coupled with the base is a boom, and a winch is further coupled with the boom. The boom and winch allow the hoist to be used to raise and lower an object.

16 Claims, 3 Drawing Sheets

PORTABLE HOIST

BACKGROUND OF THE INVENTION

A trowel machine is commonly used in the process of constructing foundations, such as those for a garage and basement, and more specifically is generally used to smooth the surface of freshly poured concrete floors. The trowel machine is commonly transported in the bed of a truck, such as a pick-up truck, and in order to use the machine, it must be lifted from the truck and lowered onto the working area. These machines are heavy and awkwardly shaped, which makes them difficult to move around. The most common method for lifting the machine from the truck and lowering it into place involves physical manpower whereby three men manually move the machine from the truck into place. This manner of moving the machine is physically demanding and can be dangerous due to the size, weight, and awkward shape of the machine. In addition, the bottom of the machine contains a number of sharp blades that can easily injure those attempting to lift and lower the machine if mishandled. Another method of moving the machine involves the use of a bobcat that is used to lift the machine using a rope or chain. However, this method requires an expensive piece of machinery. Also, a bobcat is not always available and even if it is, it is not easily transported along with the machine and it is also not specifically designed to perform this task.

Various types of hoists have been developed for lifting objects. For example, U.S. Pat. No. 6,135,300 discloses a hoist that can be mounted to the parapet of a building and that is used for lifting objects to the roof of the building. However, this hoist is not designed for raising and lowering a trowel machine. This hoist also requires a complex brace system to support the hoist. Additionally, this hoist is not suited to be attached to a foundation particularly since it is secured to the parapet with four small bolts. Not only would bolts be generally insufficient to safely support the hoist, but the bolts could cause structural damage to the wall itself, which is not desirable. Also, due to the design of this hoist, including the complex brace structure, this hoist does not allow for quick assembly, attachment, and detachment.

U.S. Pat. No. 6,499,610 discloses a hoist that can be mounted on either the roof of a building or in the bed of a truck for lifting loads. However, this hoist does not appear to have the range for either lifting a trowel machine out of a truck or lowering it into place, particularly because the hoist will be elevated off the ground and also because of the distance from the hoist, located in the bed of the truck, to the foundation. It is also not apparent that the mounting system disclosed in this patent would be adequate to support a trowel machine based on the design of the support structure for this hoist. Also, the design of the support structure of this hoist does not allow for quick assembly, attachment, and detachment.

Accordingly, a device and method for moving a trowel machine that overcomes these deficiencies are needed.

BRIEF DESCRIPTION OF THE FIGURES

The invention may be better understood with reference to the following figures and detailed description. The components in the figures are not necessarily to scale, emphasis being placed upon illustrating the principles of the invention.

DETAILED DESCRIPTION OF THE PREFERRED EMBODIMENTS

By way of introduction, the preferred embodiments described below include a portable hoist and a method of utilizing the portable hoist. The portable hoist preferably includes a base, a plurality of legs coupled with the base, a foot attached to one end of each of the legs, a boom coupled with the base, and a winch. The phrase "coupled with," as used herein, means coupled either directly or indirectly via one or more intervening elements. The hoist is designed so that it can be readily assembled, disassembled, and transported from one location to another. In use, the legs and feet are readily adjustable to facilitate securing the hoist to a structure and to facilitate removing the hoist from a structure. The design of the legs and feet provide a stable and secure connection with the structure. Also, the boom and winch allow the hoist to be used to raise and lower an object.

Figure 1:
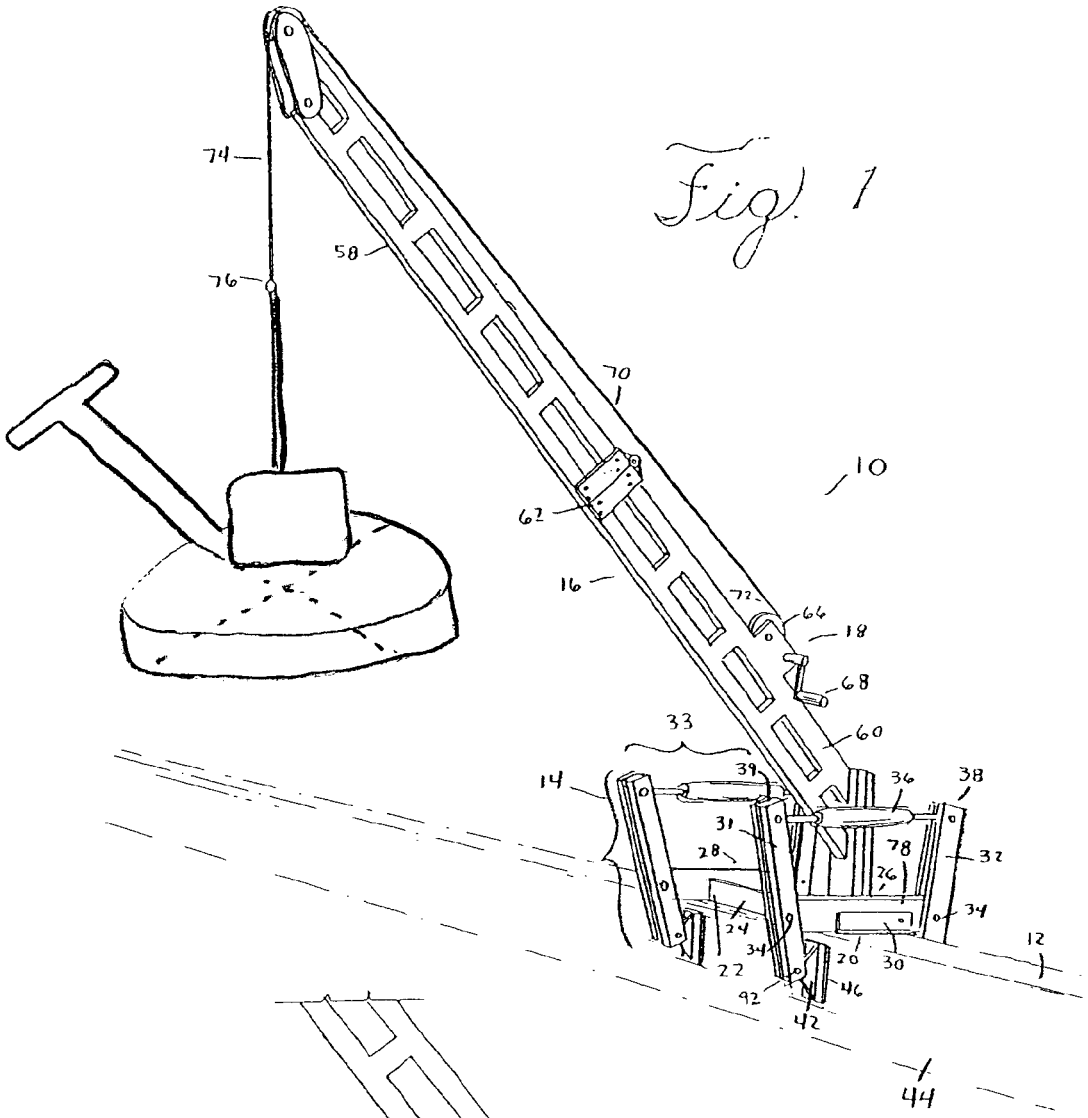
FIG. 1 is a perspective view of a portable hoist of a preferred embodiment.

By way of example, FIG. 1 shows a perspective view of a preferred embodiment of a portable hoist 10 that is adapted to be attached to a foundation wall 12 of a basement or a garage. The hoist 10 includes three components: a support member 14, a boom 16, and a winch 18. In the preferred embodiment, the support member 14 is comprised of the following components. A base plate 20 is provided that is placed on top of the foundation wall 12. The preferable shape of the base plate 20 is rectangular. However, the shape of the base plate 20 is not critical, and in alternative embodiments the base can have other shapes, such as circular, square, etc. Attached to the base plate 20 is a frame 22 preferably formed from steel. The frame 22 is preferably on the upper surface of the base plate 20, but could be on the lower surface as well if desired. The frame 22 can also be formed from aluminum, wood, plastic, any type of metal alloy formed from steel or aluminum, or any lightweight composite. In the preferred embodiment, the frame 22 has a front 24, a back 26, and two sides 28 and 30. The two sides 28 and 30 are both preferably welded to each of the front 24 and the back 26. The preferable dimensions of the frame 22 are such that the frame 22 tracks the perimeter of the base plate 20. Preferably the base plate 20 is formed from no less than quarter inch aluminum or no less than ten gauge steel. In an alternate embodiment, the frame 22 can be eliminated if the base plate 20 is formed of a sufficient thickness or provided with sufficient rigidity to support the boom 16. In another alternate embodiment, a plurality of holes can be drilled on top of the base plate 20 to accommodate an additional anchor system for the portable hoist 10.

A plurality of legs are attached to the frame 22. Preferably, at least two legs 31, 32 are coupled together to form a pair, and the pair of legs are then attached to the frame 22 at either of the two sides 28 and 30 anywhere in between the two sides 28 and 30. In the preferred embodiment of the invention, a pair of legs is attached at each end of the two sides 28 and 30 of the frame 22. The legs 31, 32 that are attached to the same side of the frame 22 are coupled with each other below the mid-point of the legs 31, 32 with a thin, rectangular plate 78, preferably formed from metal. Preferably, the legs 31, 32 and the plate 78 are formed from no less than quarter inch aluminum or 10 gauge steel. Preferably, the plate 78 is rotatably coupled with each leg 31, 32 with a pin 34, preferably a five-eighths inch quick pin, that allows each leg 31, 32 to have rotational motion relative to the plate 78. In the preferred embodiment, the pair of legs are attached to the frame 22 by inserting the plate 78 into a small gap that is formed in both sides 28 and 30 of the frame 22. The legs 31, 32 that are attached to the same side of the frame 22 are also coupled with each other at the upper end of the legs via a screw mechanism 36, which is operable to control the distance between the tops 38, 39 of the legs 31, 32. The legs 31, 32 are each preferably coupled with the screw mechanism 36 with a five-eighths inch quick pin. As the screw mechanism 36 is turned in one direction, the tops 38, 39 of the legs 31, 32 are spread apart. In a preferred embodiment, the screw mechanism 36 can be turned with a small rod that is inserted into the body of the screw mechanism 36 to ease the process of separating the tops 38, 39 of the legs 31, 32. However, because the coupling of the legs 31, 32 and the plate 78 is at a point above the bottom end of the legs 31, 32, the bottoms of the legs 31, 32 which extend beyond the frame 22 are moved towards each other while the tops 38, 39 of the legs 31, 32 are spread apart. Such action enables the portable hoist 10 to be secured to the foundation wall 12, as the legs 31, 32 make contact with the foundation wall 12 to secure the portable hoist 10. When the screw mechanism 36 is rotated in the opposite direction, the tops 38, 39 of the legs 31, 32 are brought towards each other while the bottoms of the legs 31, 32 are spread apart. Such action loosens the contact between the legs 31, 32 and the foundation wall 12, so that the portable hoist 10 can be moved if desired. Alternatively, the legs 31, 32 that are attached to the same side of the frame 22 are coupled with each other via a jacking mechanism that can be controlled in a variety of ways, including mechanically or pneumatically. The jacking mechanism is operable to control the legs 31, 32 in the same manner as the screw mechanism 36. When desired, the jacking mechanism can be operated to spread the tops 38, 39 of the legs 31, 32 apart, which simultaneously brings the bottoms of the legs 31, 32 closer together. Also, a cantilever arm can be used in place of the jacking mechanism to control the legs 31, 32 in the same manner as the screw mechanism.

Figure 3:
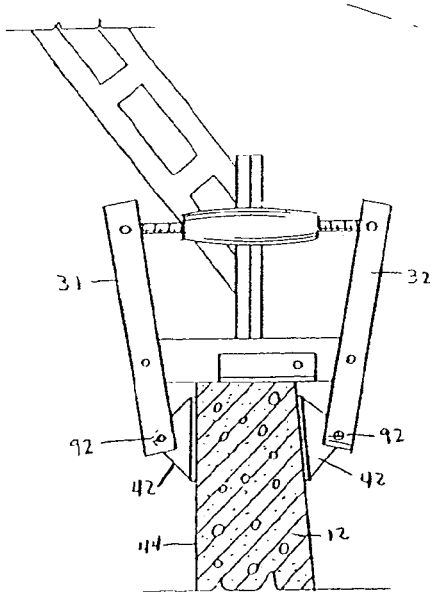
FIG. 3 is a close-up view of feet that are attached to legs of a preferred embodiment.

In addition, a foot 42 is rotatably attached to the leg 31 at the bottom of the leg 31. The foot 42 is operable to engage the side surface 44 of the foundation wall 12 to provide support for the portable hoist 10. The addition of the foot 42 to the leg 31 increases the amount of surface area of the side surface 44 of the foundation wall 12 that can be engaged compared to having just the bottom of the leg 31 itself used to engage the foundation wall 12 and support the portable hoist 10. In the preferred embodiment of the invention, a pad 46 composed of a high friction, non-slip material such as rubber is attached to the bottom side of the foot 42 which engages the foundation wall 12 to improve the ability of the foot 42 to engage the side surface 44 of the foundation wall 12 and provide stability for the portable hoist 10. The coupling of the foot 42 to the leg 31 is not a rigid one, meaning that the foot 42 is able to have some rotational motion relative to the leg 31. Preferably, the foot 42 is rotatably coupled with the leg 31 with a pin 92, preferably a five-eighths inch quick pin. As shown in FIG. 3, this feature enables the foot 42 to maintain contact with the maximum amount of surface area of the foundation wall 12 irrespective of the angle between the foot 42 and the leg 31. Therefore, even if the leg 31 is not 100% parallel with the side surface 44 of the foundation wall 12, the foot 42 is able to rotate and thus adjust so that the foot 42 remains substantially parallel with the wall 12. Therefore, the contact between the bottom of the foot 42 and the foundation wall 12 is not affected. The maximum contact between the foot 42 and the foundation wall 12 ensures that the portable hoist 10 will be secure and also ensure that the portable hoist 10 will be able to safely raise and lower the object. Preferably, the shape of the foot 42 is rectangular. However, the shape of the foot 42 is not critical, and in alternative embodiments the foot 42 can have other shapes, such as square or circular. A foot (not shown) of the type described above is also preferably coupled with the bottom of leg 32. In addition, the preferred embodiment includes a second pair of legs 33 that have the same structure (including a screw mechanism and feet) and that can be operated in the same manner as the first pair of legs. Therefore, the above description is applicable in describing the second pair of legs 33 as well.

Figure 2:
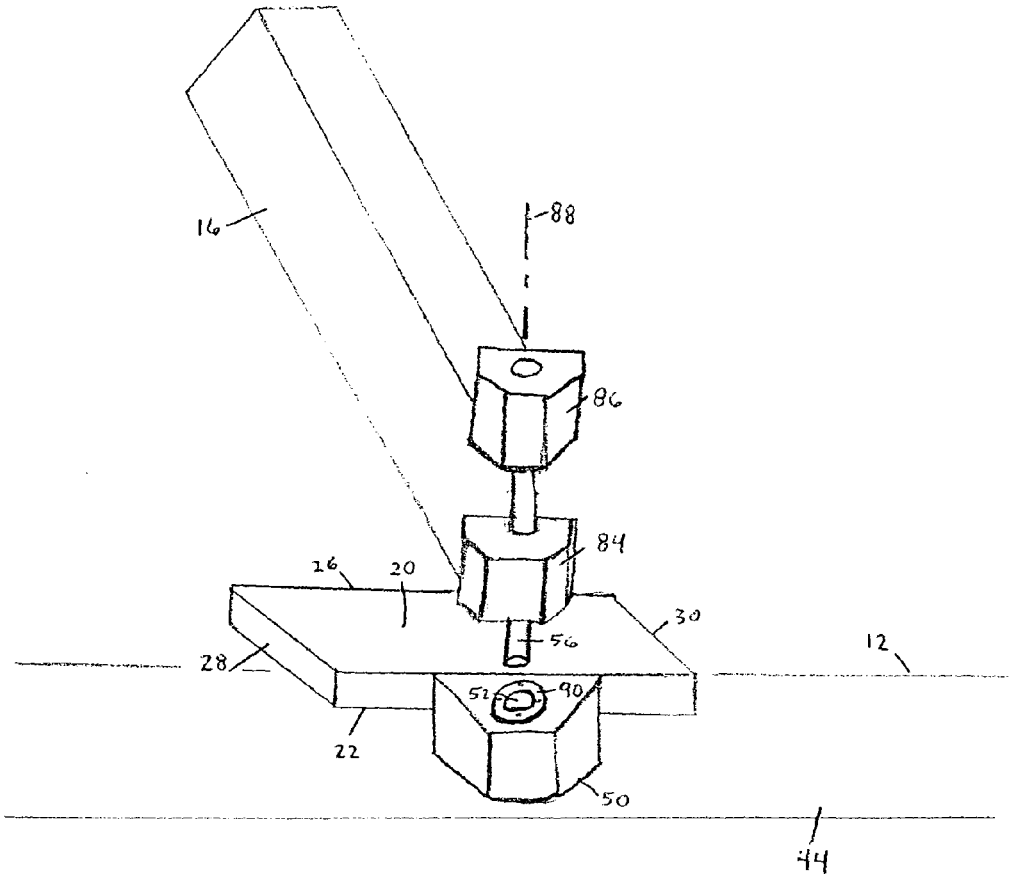
FIG. 2 is a perspective view of a boom mount and a boom for a portable hoist of a preferred embodiment.

As shown in FIG. 2, a boom mount 50 is coupled with the frame 22, preferably in a position linearly equidistant from each of the two sides 28 and 30 of the frame 22. In the preferred embodiment, the boom mount 50 is formed with a hole 52 in the middle, which extends through the bottom of the boom mount 50, into which a pin (bolt) 56 can be inserted. The top of the boom mount 50 is level with the top of the frame 22, whereas the remainder of the boom mount 50 extends down the side surface 44 of the foundation wall 12. A wear plate is secured to the bottom of the boom mount 50, on which the pin (bolt) 56 rests when it is inserted into hole 52. In the preferred embodiment, the wear plate is one-quarter inch thick, and the wear plate also has a five-eighth inch center hole through its thickness. The center hole in the wear plate allows any debris that falls into the hole 52 to escape so that the debris does not block the hole 52 or interfere with the function of the pin (bolt) 56 to secure the boom 16. In the preferred embodiment, the boom 16 is placed on top of the boom mount 50, and the boom 16 is secured to the boom mount 50 by the pin 56 (bolt). The boom 16 is preferably integral with the pin (bolt) 56. In an alternative embodiment, the boom 16 and the pin (bolt) 56 can be integrally formed together as a single piece. In the preferred embodiment, at least two teflon bushings 90 are fitted into the hole 52 of the boom mount 50, and the pin (bolt) 56 fits into the bushings 90 when the boom 16 is secured to the boom mount 50. The boom 16 is capable of rotating about a vertical axis 88 defined by the boom mount 50. The bushings 90 facilitate the ability of the boom 16 to efficiently rotate about vertical axis 88, with as little friction as possible. In the preferred embodiment of the invention, two, parallel horizontal mounting plates are affixed to the boom 16. The lower plate 84 preferably is affixed to the lower end of the boom 16. The upper plate 86 preferably is affixed to the boom 16 above the lower plate 84. The lower plate 84 and the upper plate 86 project forward to receive and capture the pin (bolt) 56 that secures the boom 16 to the boom mount 50. Each mounting plate has a hole therethrough to receive the pin (bolt) 56, preferably formed from steel. The preferable diameter of the hole is at least one and five-eighths inches. The boom 16 is integral with the pin (bolt) 56. In a preferred embodiment, the boom 16 is formed with a truss design and is formed from no less than one-eighth inch aluminum or no less than 10 gauge steel. In the preferred embodiment of the invention, the boom 16 is operable to rotate 360 degrees. In another embodiment of the invention, the rotation of the boom 16 can be limited to 180 degrees.

In one embodiment of the invention, the boom 16 has a top segment 58 and a bottom segment 60 connected by a hinge 62. The hinge 62 allows the angle between the top segment 58 and bottom segment 60 to be varied. Such variation allows the boom 16 to be folded in half and also allows for easy transportation of the entire portable hoist 10. In the preferred embodiment of the invention, when the portable hoist 10 is set up to be operable, the angle between the top segment 58 and the bottom segment 60 is 0 degrees. In an alternative embodiment of the invention, the boom 16 is comprised of only one piece. In another alternative embodiment, the top segment 58 and the bottom segment 60 of the boom 16 can be connected via a pin rather than with a hinge. In another alternative embodiment, the boom 16 is comprised of three or more separate pieces.

In the preferred embodiment of the invention, the angle between the boom 16 and the base plate 20 is forty-five degrees. However, the angle between the boom 16 and base plate 20 may be varied in other embodiments dependent upon either the wishes of the operator or the desired height at the end of the boom 16. In an alternative embodiment, the boom 16 can be adjustable so that the angle between the boom 16 and base plate 20 may be varied to adjust to differing conditions.

In the preferred embodiment of the invention, a winch 18 is coupled with the boom 16. In an alternative embodiment of the invention, the winch 18 can be coupled with the base plate 20. Preferably, the winch 18 is formed of a solid cylinder or spool 66 that is attached to a hand crank 68 for a user to operably rotate the cylinder or spool 66. One end 72 of a wire 70 is secured to the cylinder or spool 66, with the remainder of the wire 70 wound around the spool or cylinder 66, spread along the length of the boom 16, and hanging over the far end of the boom 16. In other embodiments of the invention, the wire 70 can be replaced with a cable, strap, chain, rope, or other material suitable for use with a winch for lifting objects. Preferably, the other end 74 of the wire 70 is attached to an open hook 76 that can be attached to an object for raising and lowering the object. In other embodiments of the present invention, the hook 76 can be replaced with a closed hook, a plate gripper, a lifting bar, or a clevis. When the hand crank 68 is used to rotate the cylinder or spool 66, the rotation of the cylinder or spool 66 also causes the wire 70 to be spooled or un-spooled from the cylinder or spool 66. The operation of the winch 18 causes any object attached to the wire 70 to be raised or lowered according to the wishes of the operator. In alternative embodiments, the winch 18 can be either pneumatically or electrically operated, rather than user-operated via the hand crank.

Figure 4:
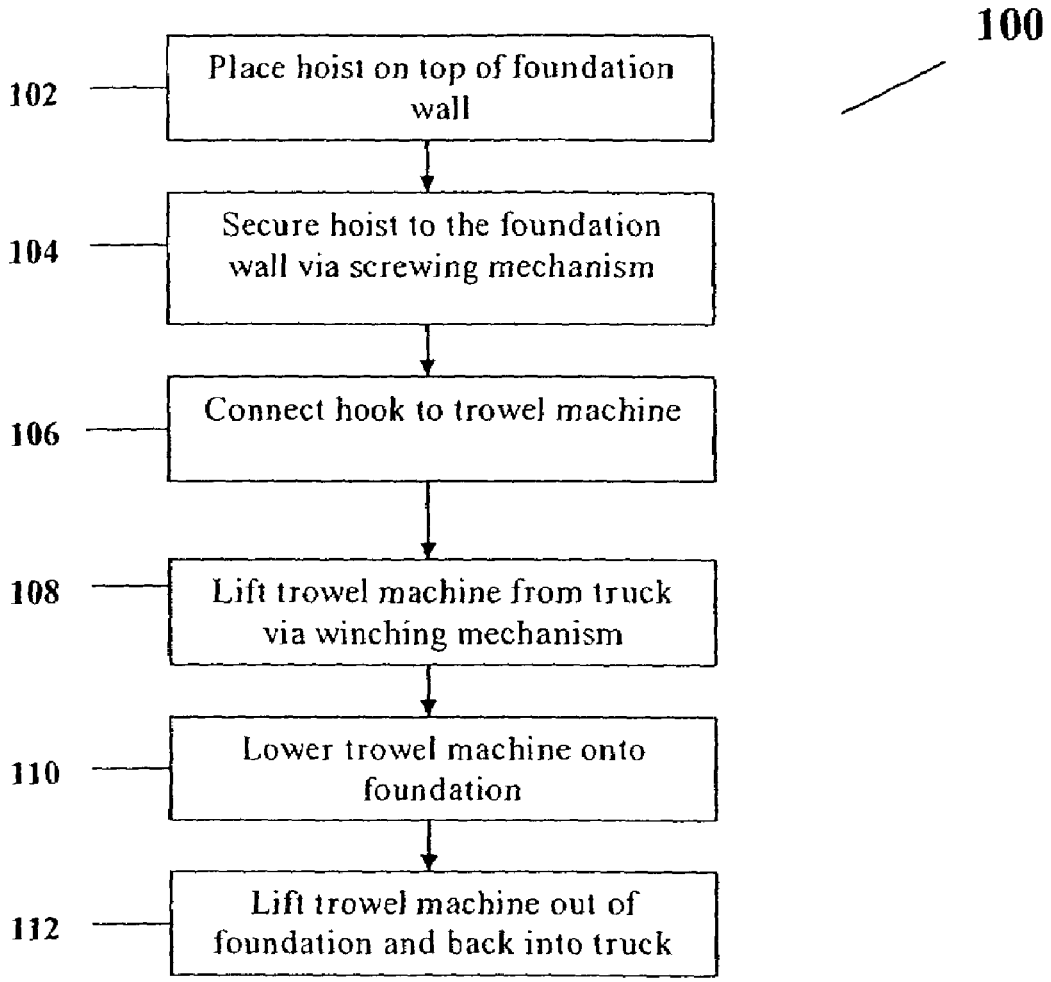
FIG. 4 is a flow chart for a method of using a portable hoist to move a trowel machine of a preferred embodiment.

The portable hoist 10 shown in FIG. 1, as well as described above, can be used to horizontally and vertically move a trowel machine, as shown in the method 100 illustrated in FIG. 4. By way of example, the trowel machine is commonly transported in the bed of a truck, such as a pick-up truck. The portable hoist 10 is secured to a foundation wall 12, such as those surrounding a basement or garage. In the preferred method of use, the portable hoist 10 is placed on top of the foundation wall 12 (act 102, FIG. 4) and then the portable hoist 10 is secured to the foundation wall 12 by using the screwing mechanism 36 provided between the legs 31, 32 of the portable hoist 10 (act 104, FIG. 4). The screwing mechanism 36 is operable to move the legs 31, 32 and also provide a connection between the feet coupled with the legs 31, 32 and the side surface 44 of the foundation wall 12. After the portable hoist 10 is secured to the foundation wall 12, the trowel machine, while in the bed of the truck, is attached to the boom 16 via a winching mechanism 18. The winching mechanism 18 is attached to a wire 70, which is used to raise and lower the trowel machine. Preferably, a hook 76, attached to one end 74 of the wire 70, is connected or attached to a portion of the trowel machine (act 106, FIG. 4). When the trowel machine is secured to the hook 76, the winching mechanism 18 is operated to lift the machine from the truck (act 108, FIG. 4). The boom 16 can then be rotated to place the trowel machine over the foundation. The winching mechanism 18 is then used to lower the machine into the foundation (act 110, FIG. 4), where the machine is disconnected from the hook 76 and operated to accomplish its objective of finishing the concrete floor. The winching mechanism 18 can then be used to lift the trowel machine out of the foundation and back into the truck (act 112, FIG. 4). As the above description demonstrates, the portable hoist 10 can be operated by only one person to easily and safely move the trowel machine. The portable hoist 10 can also be used to move objects from various vehicles and places.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light necessitated by the accompanying claims and their equivalents.

I claim:

1. A portable hoist, comprising:

a base;

a first pair of legs coupled with the base, the first pair of legs comprising:

a first leg having a top end, a bottom end, and a first foot rotatably attached to the bottom end of the first leg;

a second leg having a top end, a bottom end, and a second foot rotatably attached to the bottom end of the second leg;

a first screwing mechanism having a first end and a second end disposed between the first leg and the second leg, wherein the first end of the first screwing mechanism is attached to the top end of the first leg and the second end of the first screwing mechanism is attached to the top end of the second leg and the first screwing mechanism is located above the base, wherein rotation of the first screwing mechanism in a first direction causes the top end of the first leg to be moved apart from the top end of the second leg while the first foot attached to the bottom of the first leg is moved towards the second foot attached to the bottom of the second leg, and rotation of the first screwing mechanism in a direction opposite the first direction causes the top ends of the first and second legs to be moved together while the first and second feet attached to the bottom ends of the first and second legs are moved apart;

a second pair of legs coupled with the base, the second pair of legs comprising:

a third leg having a top end, a bottom end, and a third foot rotatably attached to the bottom end of the third leg;

a fourth leg having a top end, a bottom end, and a fourth foot rotatably attached to the bottom end of the fourth leg;

a second screwing mechanism having a first end and a second end disposed between the third leg and the fourth leg, wherein the first end of the second screwing mechanism is attached to the top end of the third leg and the second end of the second screwing mechanism is attached to the top end of the fourth leg and the second screwing mechanism is located above the base, wherein rotation of the second screwing mechanism in a first direction causes the top end of the third leg to be moved apart from the top end of the fourth leg while the third foot attached to the bottom of the third leg is moved towards the fourth foot attached to the bottom of the fourth leg, and rotation of the second screwing mechanism in a direction opposite the first direction causes the top ends of the third and fourth legs to be moved together while the third and fourth feet attached to the bottom ends of the third and fourth legs are moved apart;

a boom coupled with the base; and a winch coupled with the boom.

2. The portable hoist according to claim 1, wherein the portable hoist is adaptable to be attached to the top of a foundation wall.

3. The portable hoist according to claim 2, wherein the foundation wall has a thickness between six inches and twelve inches.

4. The portable hoist according to claim 1, wherein the boom comprises an upper section and a lower section, the upper section and the lower section being connected by a hinge, wherein the hinge is operable to provide a flexible connection between the upper section and the lower section.

5. The portable hoist according to claim 1, wherein the winch is electrically operated.

6. The portable hoist according to claim 1, wherein the winch is mechanically operated.

7. The portable hoist according to claim 1, wherein the winch is operable for controlling a retractable cable attached to the winch.

8. The portable hoist according to claim 1, wherein the base is formed from no less than quarter inch aluminum.

9. The portable hoist according to claim 1, wherein the base is formed from no less than ten gauge steel.

10. The portable hoist according to claim 1, wherein the first pair of legs and the second pair of legs are formed from no less than quarter inch aluminum.

11. The portable hoist according to claim 1, wherein the first pair of legs and the second pair of legs are formed from no less than ten gauge steel.

12. The portable hoist according to claim 1, wherein the boom is formed from one-eighth inch aluminum.

13. The portable hoist according to claim 1, wherein the boom is formed from no less than ten gauge steel.

14. The portable hoist according to claim 1, wherein the first, second, third, and fourth feet are rectangular in shape.

15. The portable hoist according to claim 1, wherein the boom is capable of rotating 360 degrees.

16. The portable hoist according to claim 1, wherein the base comprises a plate, a frame coupled with the plate, and a boom mount coupled with the frame, wherein the boom is pivotally connected to the boom mount.

* * * * *